US007178680B2

(12) United States Patent
Botner

(10) Patent No.: US 7,178,680 B2
(45) Date of Patent: Feb. 20, 2007

(54) RACK AND TRAY ASSEMBLY FOR FOOT APPAREL

(76) Inventor: Karen Lynn Botner, 11780 141st Cir., Dayton, MN (US) 55327

( * ) Notice: Subject to any disclaimer, the term of this patent is extended or adjusted under 35 U.S.C. 154(b) by 75 days.

(21) Appl. No.: 10/802,423

(22) Filed: Mar. 17, 2004

(65) Prior Publication Data

US 2005/0205499 A1 Sep. 22, 2005

(51) Int. Cl.
*A47F 7/08* (2006.01)

(52) U.S. Cl. ..... 211/34; 211/37; 211/38; 211/132.1; 211/198; 108/163

(58) Field of Classification Search ..... 211/34–38, 211/198; 108/163, 168; 126/505, 9; 99/426, 99/444, 445; 217/132.1, 133.2, 133.5, 149; D7/408

See application file for complete search history.

(56) References Cited

U.S. PATENT DOCUMENTS 1,167,550 A * 1/1916 Forsyth ..... 108/163
1,650,634 A * 11/1927 Lutzler ..... 99/446
1,837,263 A * 12/1931 Glidden ..... 211/34
2,006,385 A * 7/1935 Dikeman ..... 99/446
2,564,523 A * 8/1951 Ellis ..... 5/507.1
3,199,438 A * 8/1965 Myler et al. ..... 99/421 R
3,589,522 A * 6/1971 Chiodo ..... 211/34
3,762,573 A * 10/1973 Collins et al. ..... 211/34
3,788,241 A 1/1974 Ravreby
4,488,535 A * 12/1984 Johnson ..... 126/25 A
4,862,795 A * 9/1989 Hawkins ..... 99/446
4,953,473 A * 9/1990 Tomaka et al. ..... 108/132
5,016,364 A * 5/1991 Cochrane ..... 34/202
5,152,407 A 10/1992 Massoudnia et al.

* cited by examiner

*Primary Examiner*—Richard E. Chilcot, Jr.
*Assistant Examiner*—Jared W. Newton
(74) *Attorney, Agent, or Firm*—Michael A. Mochinski

(57) ABSTRACT

A rack and tray assembly for supporting foot apparel and collecting and retaining water, snow and debris temporally released therefrom. The rack and tray assembly comprising a folding frame structure having left and right legs and a tray support assembly situated and mounted thereinbetween for supporting at least one tray. Each tray comprising inclined sides extending upwardly from a base and terminating an upper rim collectively forming a reservoir for holding and retaining water, snow, and debris released from foot apparel. The upper rim comprising a ledge having an upper exposed surface for receiving thereon a grate and a lower exposed surface for engaging left and right tray rails integrally made part of and extending downwardly from the tray support assembly, which substantially serve to position each tray above a floor's surface to prevent inadvertent spillage of water, snow and debris contained therein.

14 Claims, 9 Drawing Sheets

RACK AND TRAY ASSEMBLY FOR FOOT APPAREL

FIELD OF THE INVENTION

The present invention relates in general to a rack and tray assembly for storing foot apparel in a residential or commercial setting. More specifically, the present invention comprises means for storing foot apparel and the like while simultaneously allowing for the collection and retention of water, snow and debris temporally released therefrom.

BACKGROUND OF THE INVENTION

Storage of shoes remains a problem especially in the modem home. Today's home equally serves the purpose of providing shelter and creating a physical manifestation of an individual's personality, interests and wealth. To that end modern homes often have grand entrances and/or fine interior treatments such as hardwood floors, expensive carpeting, natural stone tiles, or exotic antique rugs. To protect these interior treatments, homeowners often require occupants and guests to remove their shoes upon entering the home.

In addition to protecting interior treatments, shoes are often removed to prevent water, snow and debris from entering the home, thus keeping interior surfaces cleaner longer. Children, because of their immaturity and size will often walk in water, snow and debris unwittingly or for fun. Their small size often causes their shoes to contact the surfaces of furniture, as they often need to climb into the normal seating position assumed by an adult.

Many cultures require the removal of shoes before entering the home for a variety of reasons. In some cultures it is feared that debris carried into the home on shoes will cause sickness in small children who on occasion crawl around the floor surface. Shoes are also removed to maintain clean floors for purposes of religion. For example, having clean floors is vital for some religious observances that require individuals to occupy the floor several times daily.

Shoes with mild to moderate traction enhancing soles are capable of carrying significant quantities of water, snow and debris into a home. The average shoe can carry upwards of 5–10 mL of rain water and as much as 15–25 mL of water from melting snow. In regions that experience moderate amounts of snowfall annually, it is a constant battle to prevent water, snow and debris from entering the home. This problem is so significant that architects have sought to address this problem through a home's design by including mud rooms or other designated areas to remove wet-, snow- or mud-covered shoes and garments.

Today, individuals tend to own multiple pairs of shoes and on occasion invite several guests to their home at once. This situation will cause numerous pairs of shoes to accumulate near the door covering a substantial area of the floor. This situation can create a variety of safety hazards. Shoe clutter can prevent the free swinging movement of doors baring entry and exit from a dwelling. As few as one pair of shoes saturated with rain water or melting snow can create a wet slippery floor inviting injury from a fall. Unorganized shoes also create a tripping hazard by their mere presence near the door or otherwise in a home's traffic pattern.

Typically an inexpensive washable rug is often selected to serve as a collection point for shoes. Rugs such as these can quickly become saturated with water and debris thus necessitating frequent cleaning and have a limited shoe capacity as defined by their size. Further inexpensive rugs often do not necessarily complement the interior of today's finely furnished home. Also rugs of this type when saturated with water and debris do little to protect the floor beneath it. Rugs only offer minimal protection to floors because water can soak through most and they do very little to contain the lateral dispersion of debris. With most rugs of this type, shoes can remain in contact with both water and debris for a sustainable period of time. Also, multiple pairs of shoes may end up being inadvertently stacked atop of one another causing water and debris to contact other shoes risking damage not only to the floor but also to other shoes nearby.

The prior art contains numerous devices for organizing and storing shoes. The typical prior art device consists of a solid frame constructed of wood or plastic with a number of shelves being designated to hold shoes in a predetermined fashion. Still others rely upon another supporting structure such as a door to suspend a series of plastic, fabric or cardboard shelves. These shelves are often constructed in close proximity to one another to maximize the number of shoes stored in the smallest area possible. Such shelves can become damaged by water, snow or mud remaining on shoes placed in them. Since the shelves are placed in close proximity to maximize space this also minimizes air circulation and prolongs drying times for shoes and shelving materials. The shelving materials can quickly become damaged and dirty with no ready or anticipated way to disassemble or clean them.

Other prior art shoe racks possess the capability to store numerous pairs of shoes, but do so in an open design that hangs shoes from hooks, loops or pegs attached to and extending outwardly from the rack. This rack is still not aesthetically pleasing and does not offer sufficient means to collect water or debris from shoes. Another disadvantage of this type of rack, especially in a vertical configuration, is that water and debris from one shoe can impermissibly contact other shoes. These racks can also become damaged and dirty with no ready or anticipated way to disassemble or clean them as hereinbefore mentioned. Also, this type of rack, like many other prior art devices, is incapable or does not allow the user to comfortably sit on the rack to remove shoes prior to placement therewithin.

In accordance with the present invention, applicant has appreciably devised a shoe rack and tray assembly that is aesthetically pleasing for the modern home, can store and organize one or more pairs of shoes, can protect the interior space of a home and prevent damage to the rack itself or other shoes, can contain ample amounts of water, snow or debris, and is easily removed from its location for emptying and thorough cleaning.

BRIEF SUMMARY OF THE INVENTION

In order to overcome the numerous drawbacks apparent in the prior art, a rack and tray assembly has been devised for organizing and storing foot apparel in a residential and commercial setting.

It is thus an object of the present invention to provide a rack and tray assembly to shelve shoes in an aesthetically pleasing manner for the modern home.

It is another object of the present invention to provide such a rack and tray assembly capable of containing ample amounts of water, snow and debris originating from foot apparel and the like.

It is another object of the present invention to provide a rack and tray assembly that allows adequate air circulation for drying shoes while simultaneously allowing water, snow and debris to separate from soles or bottom surfaces of foot apparel and the like.

It is another object of the present invention to provide a rack and tray assembly capable of being easily removed from its location for emptying collected water, snow and debris released from foot apparel.

It is yet another object of the present invention to provide a rack and tray assembly which accomplishes the foregoing and other objects and advantages and which is economical, durable, and fully effective in performing its intended functions without unduly compromising the entryway of residential and commercial buildings.

In accordance with the present invention, a rack and tray assembly has been devised for storing foot apparel and collecting debris and liquids released therefrom, the assembly comprising a folding frame structure comprising left and right legs and a tray support assembly situated and mounted thereinbetween for supporting at least one tray; the tray comprising inclined sides extending upwardly from a base and terminating an upper rim collectively forming a reservoir for holding and retaining water, snow, and debris released from foot apparel; the upper rim comprising a ledge having an upper exposed surface for receiving thereon a grate and a lower exposed surface for engaging left and right tray rails integrally made part of and extending downwardly from the tray support assembly, which substantially serve to position the tray above the floor to prevent inadvertent spillage of water, snow and debris contained therein.

Other objects, features, and advantages of the present invention will become apparent in the following detailed description of the preferred embodiments thereof when read in conjunction with the accompanying drawings in which like reference numerals depict the same parts in the various views.

BRIEF DESCRIPTION OF THE DRAWINGS

A preferred embodiment of the present invention will now be described by way of example with reference to the accompanying drawings, in which.

DETAILED DESCRIPTION OF THE INVENTION

While this invention is susceptible of being embodied in many different forms, the preferred embodiment of the invention is illustrated in the accompanying drawings and described in detail hereinafter with the understanding that the present disclosure is to be considered to exemplify the principles of the present invention and is not intended to limit the invention to the embodiments illustrated and presented herein. The present invention has particular utility as a device for holding and storing foot apparel and the like and collecting and retaining water, snow and debris temporally released therefrom.

Figure 1:
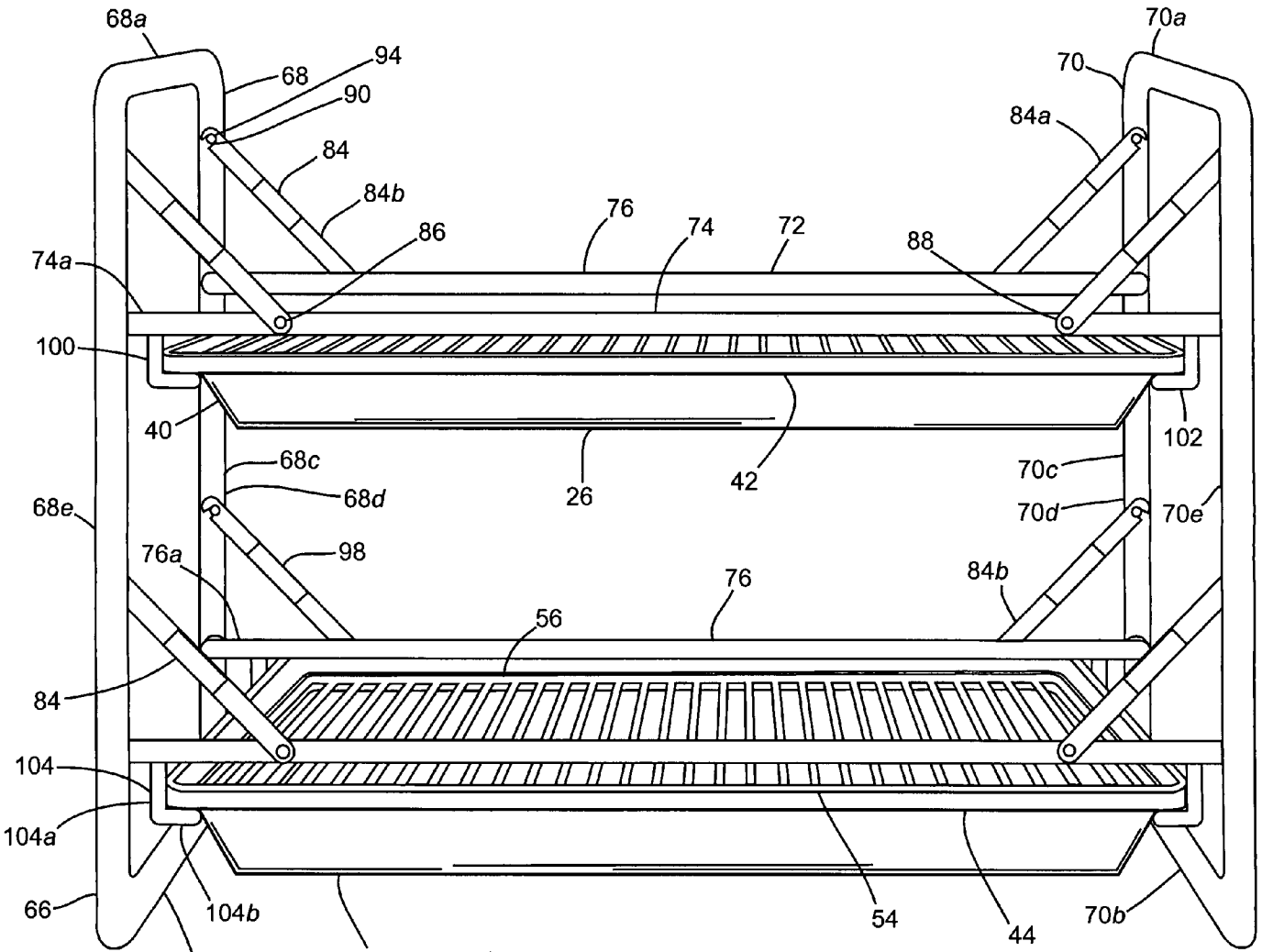
FIG. 1 is a front perspective view of the preferred embodiment of the present invention illustrating a folding frame structure arranged with a pair of tray support assemblies each comprising a tray with an interiorly situated grate collectively positioned therebelow.
Figure 2:
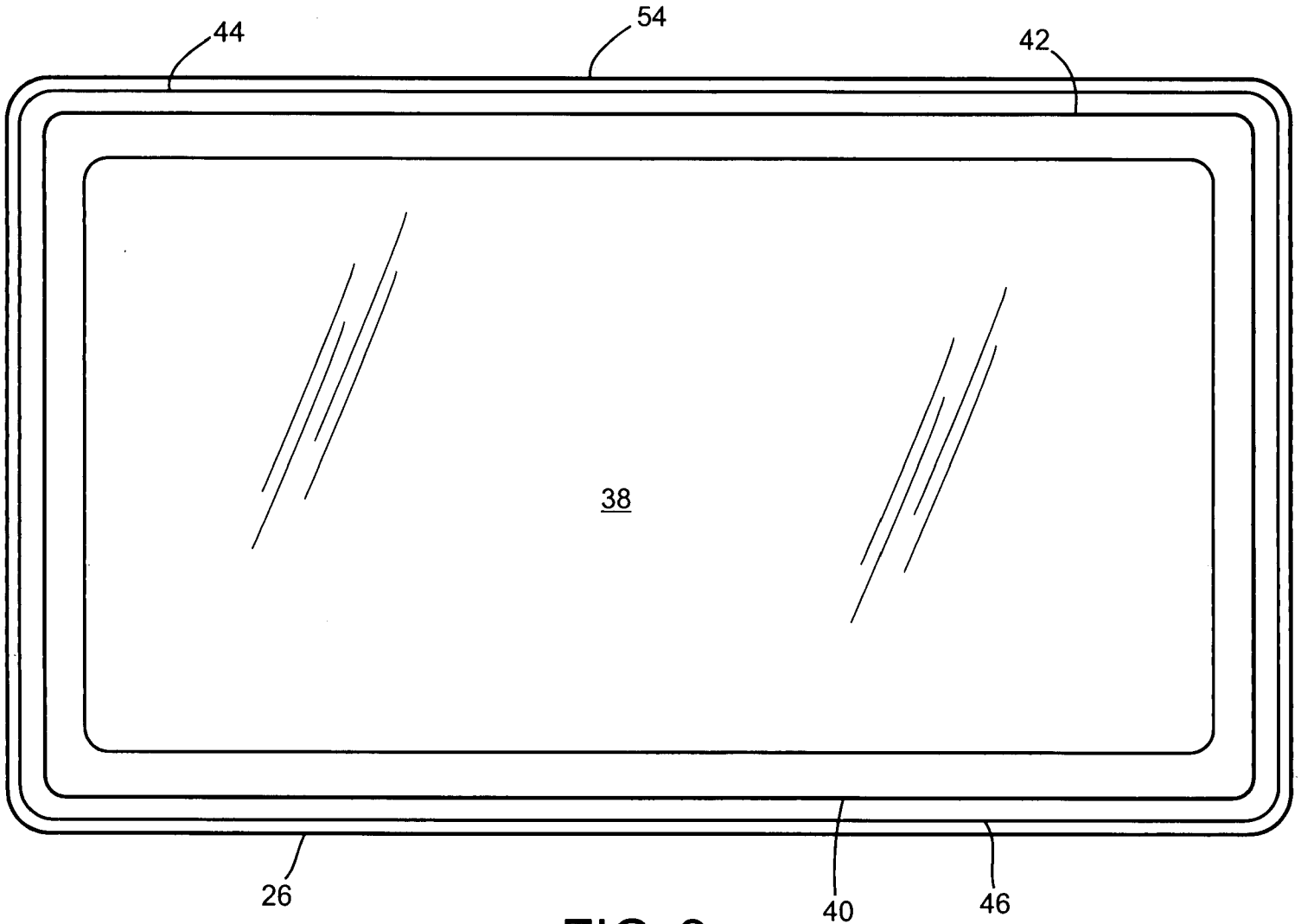
FIG. 2 is a top plan view of the preferred embodiment of the present invention illustrating a tray.
Figure 3:
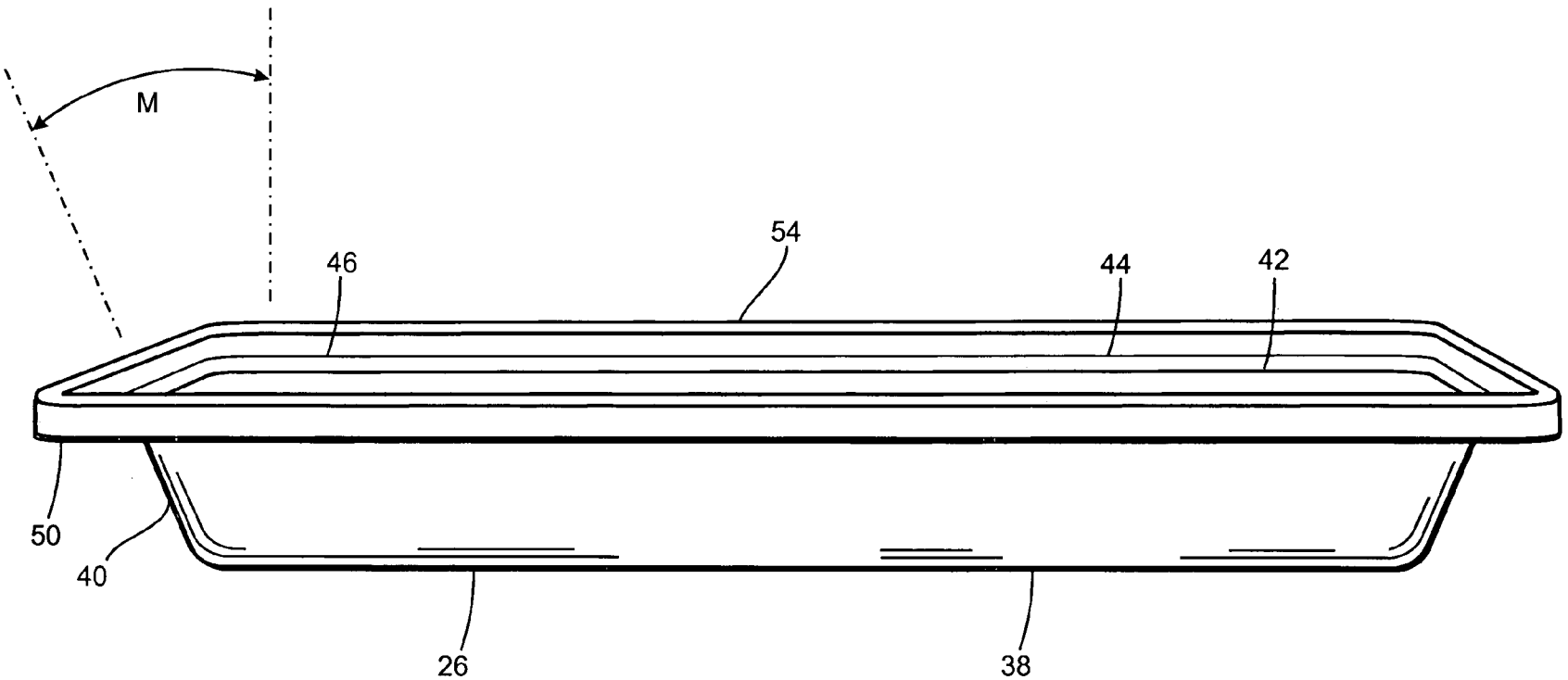
FIG. 3 is a front perspective view of the preferred embodiment of the present invention illustrating a tray.
Figure 4:
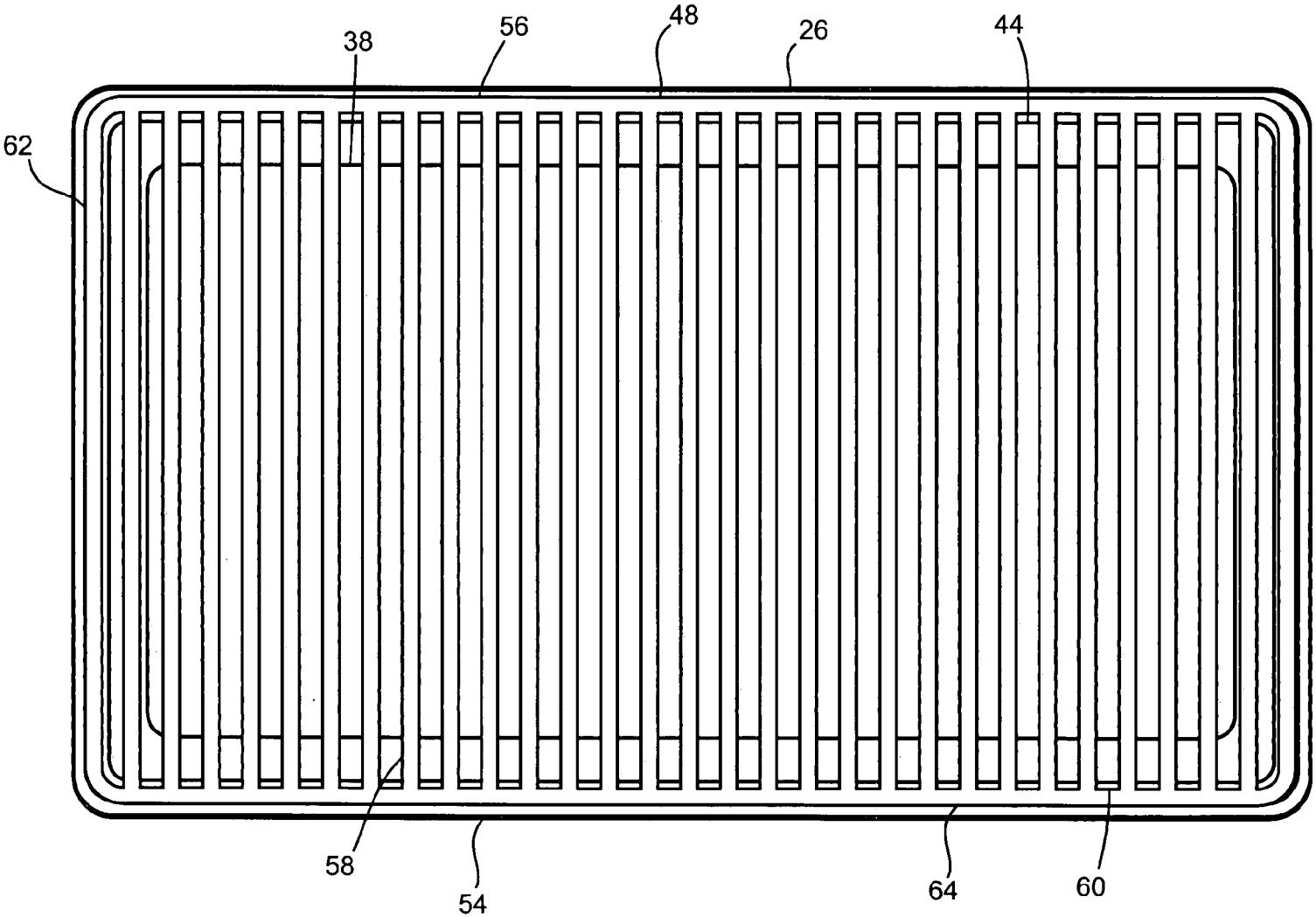
FIG. 4 is a top plan view of the preferred embodiment of the present invention illustrating a tray interiorly fitted with a grate.
Figure 5:
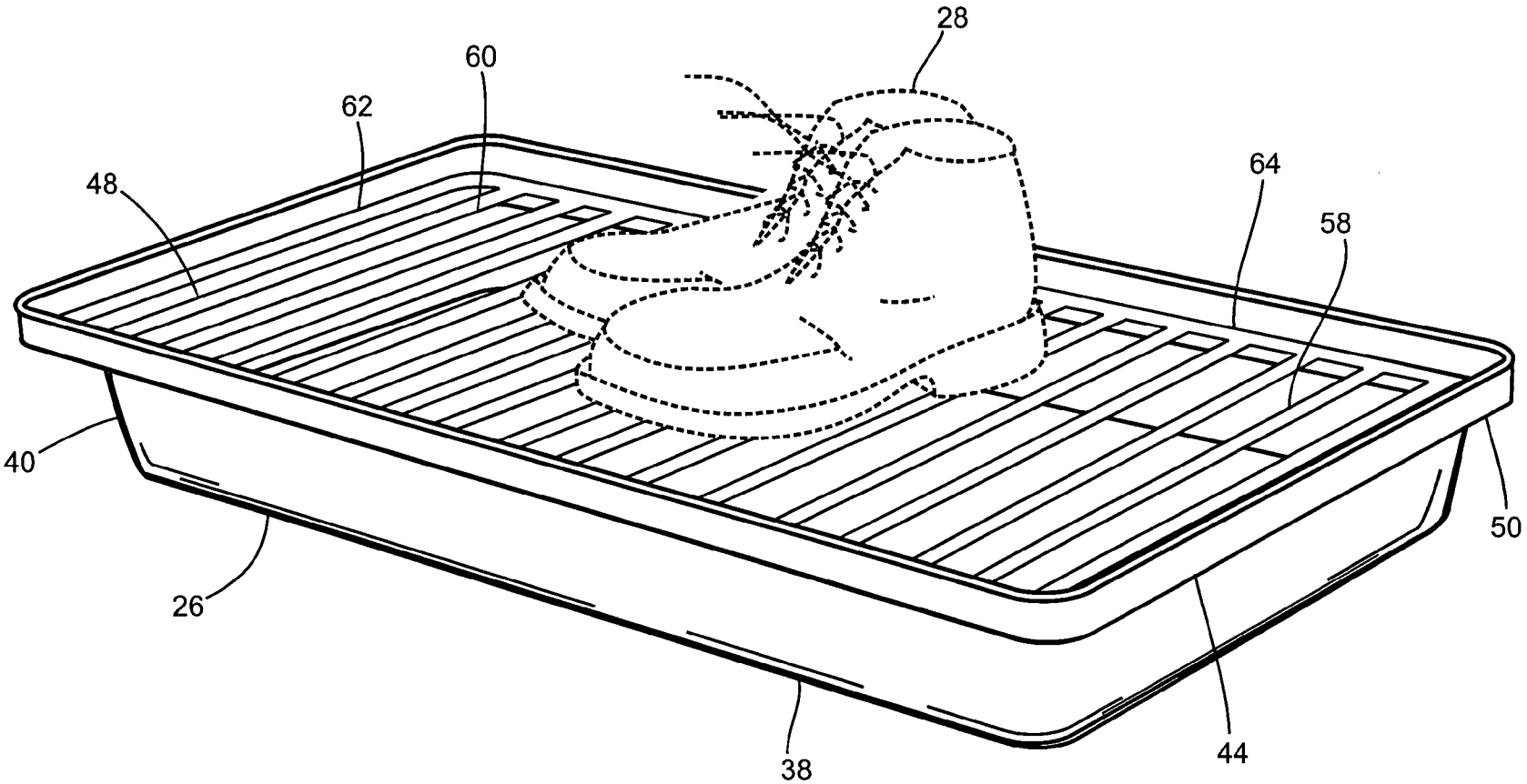
FIG. 5 is a front perspective view of a preferred embodiment of the present invention illustrating a tray interiorly fitted with a grate for supporting foot apparel atop thereof.

Referring now to FIG. 1, there is shown generally at 10 a rack assembly fitted with trays 26 each primarily serving as a reservoir for collecting water, snow and debris released from foot apparel 28 situated atop a grate 48 interiorly fitted within the tray. As shown in FIG. 2, each tray preferably comprises a base 38 integrally connected to inclined sides 40 extending upwardly therefrom, along the periphery thereof and terminating at an upper rim 42. The inclined sides primarily function to prevent the accumulation of debris thereabout while allowing continuous flow downwardly toward the base to ensure full usage of the tray's volumetric capacity. In most applications, the inclined sides are positioned outwardly in angular fashion by approximately 25° to an axis perpendicular to the base to further this purpose, as best illustrated along path M in FIG. 3. The upper rim 42 comprises a ledge 44 having an upper exposed surface 46 for receiving thereon grate 48 and a lower exposed surface 50 for engaging an upper portion 52 of the guide rail. Integrally made part of the rim is a supportive wall 54 extending upwardly from the upper exposed surface of the ledge 44. The supportive wall primarily serves as means for maintaining the orientation and position of the grate while positioned atop the upper exposed surface and reinforcing the structural integrity of the rim 42 while bearing loads comprising foot apparel, water, snow, and debris. As shown in FIG. 4, the grate comprises a frame 56 having an overall geometric configuration corresponding to the arrangement of the ledge insofar to allow the frame to rest entirely upon the upper exposed surface 46. A plurality of support members 58 positioned within and integrally connected to the frame 56 collectively serve as means for supporting foot apparel 28 while simultaneously allowing the passing of water, snow and debris into the tray 26, as depicted in FIG. 5. Accordingly, the support members are positioned parallel to and spaced equally apart from one another within the frame to form and define a plurality of elongate openings 60. It is noted herein that the orientation and spacing of the support members may vary in each application to accommodate a variety of shoe types yet affording passage of water, snow and debris collectively released therefrom. For instance, the support members of elongate configuration as illustrated in FIG. 4 may extend parallel to a pair of shortened end members 62 of the frame and connect to and terminate at side members 64 of the frame to enhance the overall structural integrity of the grate to the extent of mitigating deformation of the grate upon placing heavily weighted foot apparel thereon. Preferably, the frame as well as the support members fitted therewithin collectively comprises a uniform height suitably corresponding to the height of the supportive wall 54. This configuration ensures that the rim 42 and its structural features do not unduly interfere with the foot apparel as it is slidably removed from and placed about the grate 48. The grate in its preferred embodiment is constructed of strong lightweight metal coated with vinyl. Lightweight metal suitably serves in strengthening the grate to maintain rigidity while lessening the overall weight of the tray and grate to enhance its handling capacity. The vinyl coating is an attractive inexpensive material to provide corrosion protection to metal that may contact water and snow released from the foot apparel. It is anticipated that any material comprising the above-noted characteristics, such as wood, plastic, carbon fiber, or a combination thereof, may be used to construct the grate providing it offers resistance to premature corrosion during normal usage. In typical applications, the tray preferably comprises a width of approximately 24" and a length of approximately 16", forming a surface area notably capable of holding two large pairs of shoes. In regard to this rectangular dimension and a depth of approximately 1.5", the tray sufficiently comprises a volumetric capacity to hold and retain a liquid and solid mixture released from approximately ten pairs of shoes over a 1–2 week period. More continuous usage, particularly during snowy conditions, may necessitate frequent handling of the tray for purposes of emptying and cleaning or usage of a tray having a larger volumetric capacity to what has been described for the preferred embodiment.

Figure 6:
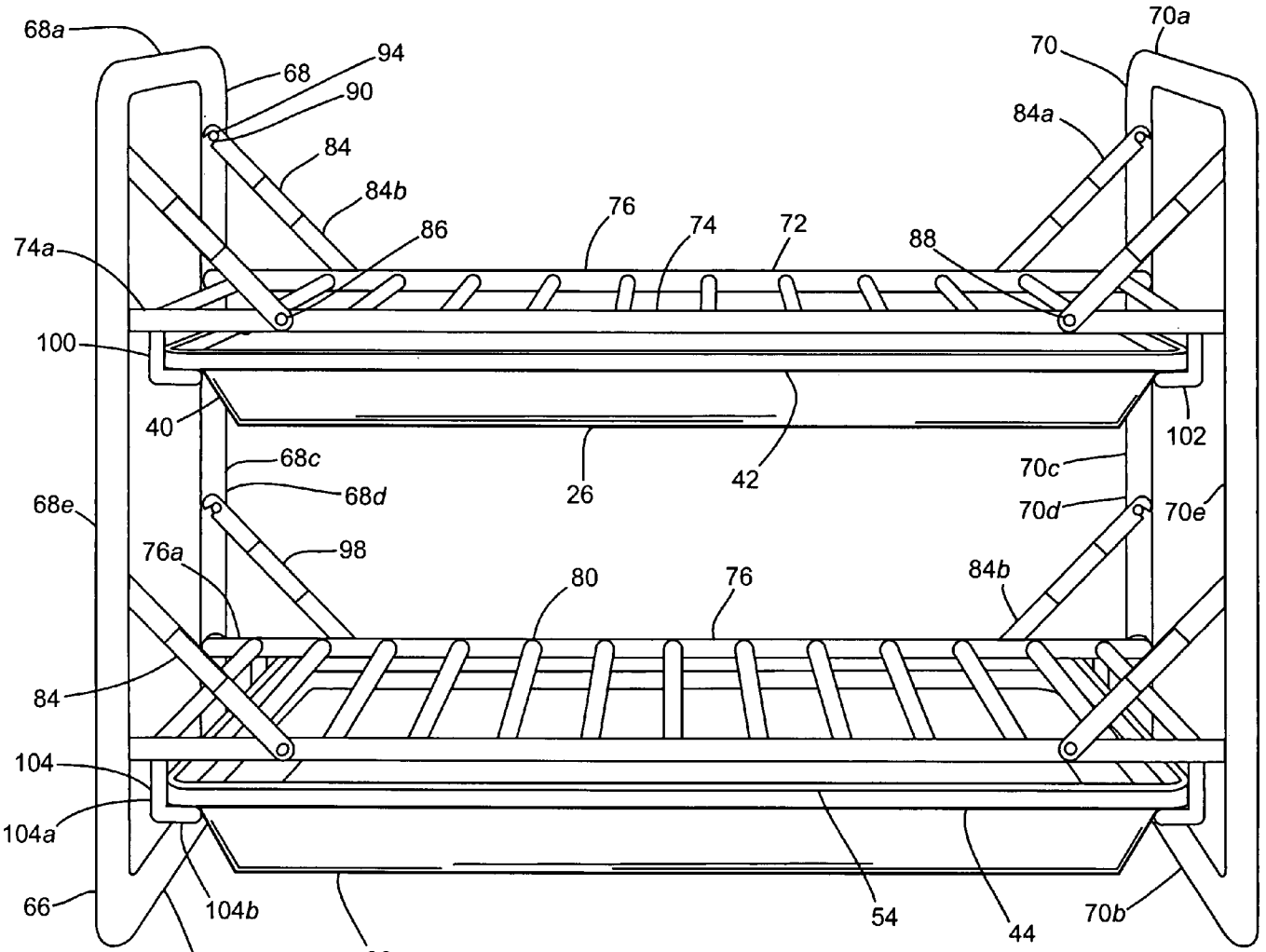
FIG. 6 is a front perspective view of an alternative embodiment of the present invention illustrating a folding frame structure fitted with a pair of tray support assemblies each comprising a tray positioned therebelow.
Figure 7:
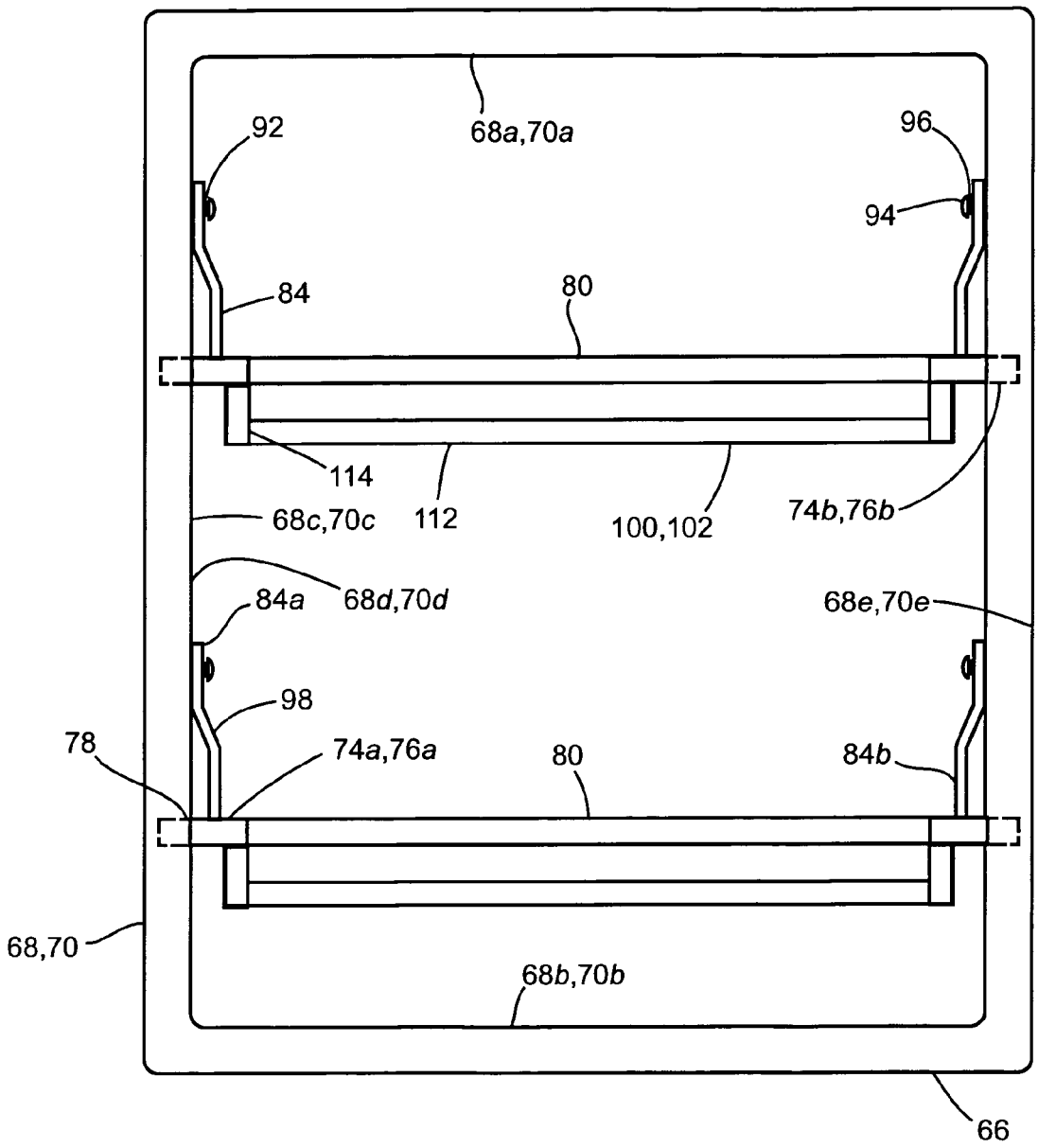
FIG. 7 is a mirror end view of the alternative embodiment of the present invention illustrating a pair of tray support assemblies positioned in between elongate vertical members of a leg.
Figure 8:
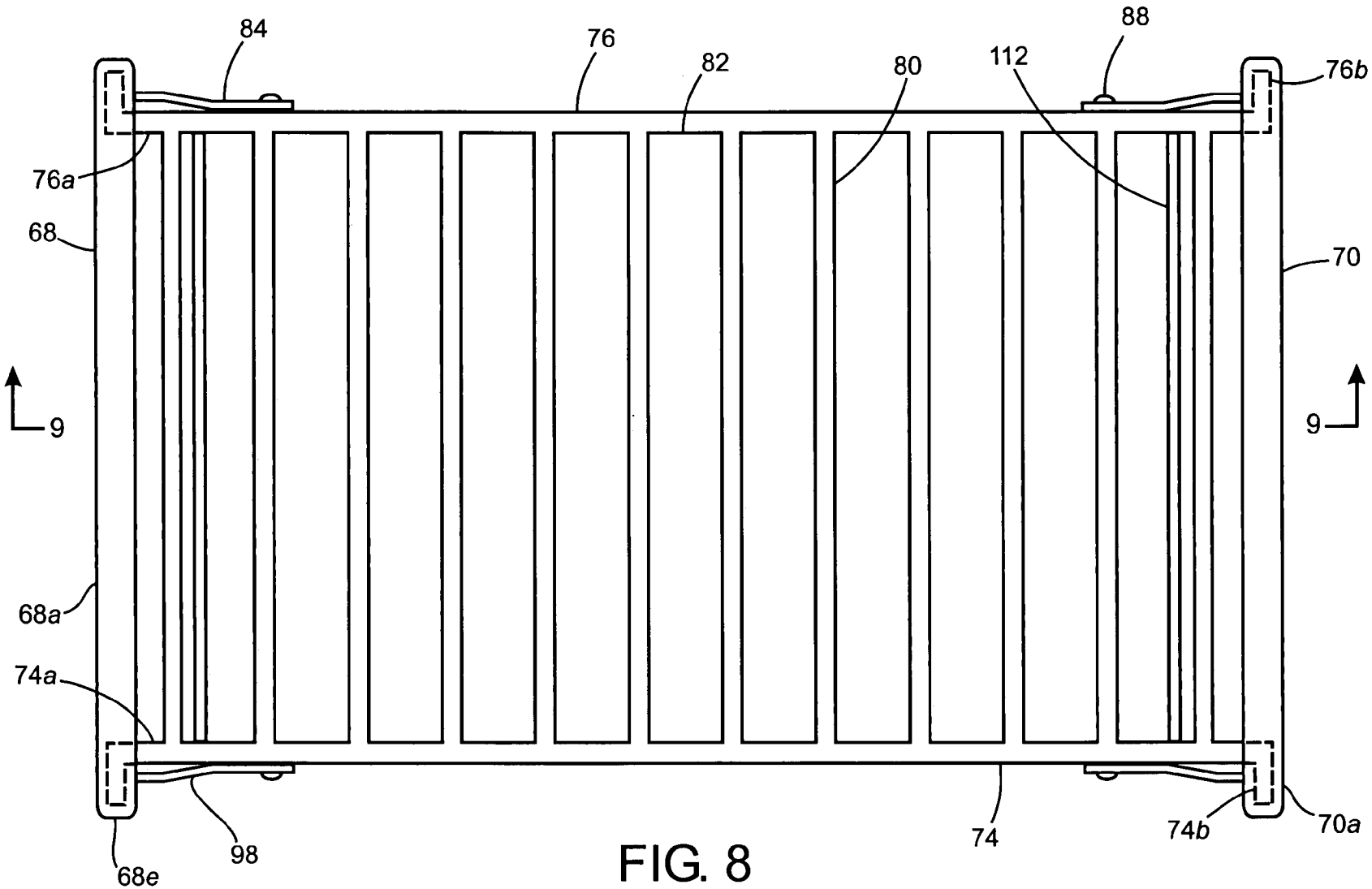
FIG. 8 is a top plan view of the alternative embodiment of the present invention illustrating a tray support assembly positioned in between left and right legs.
Figure 9:
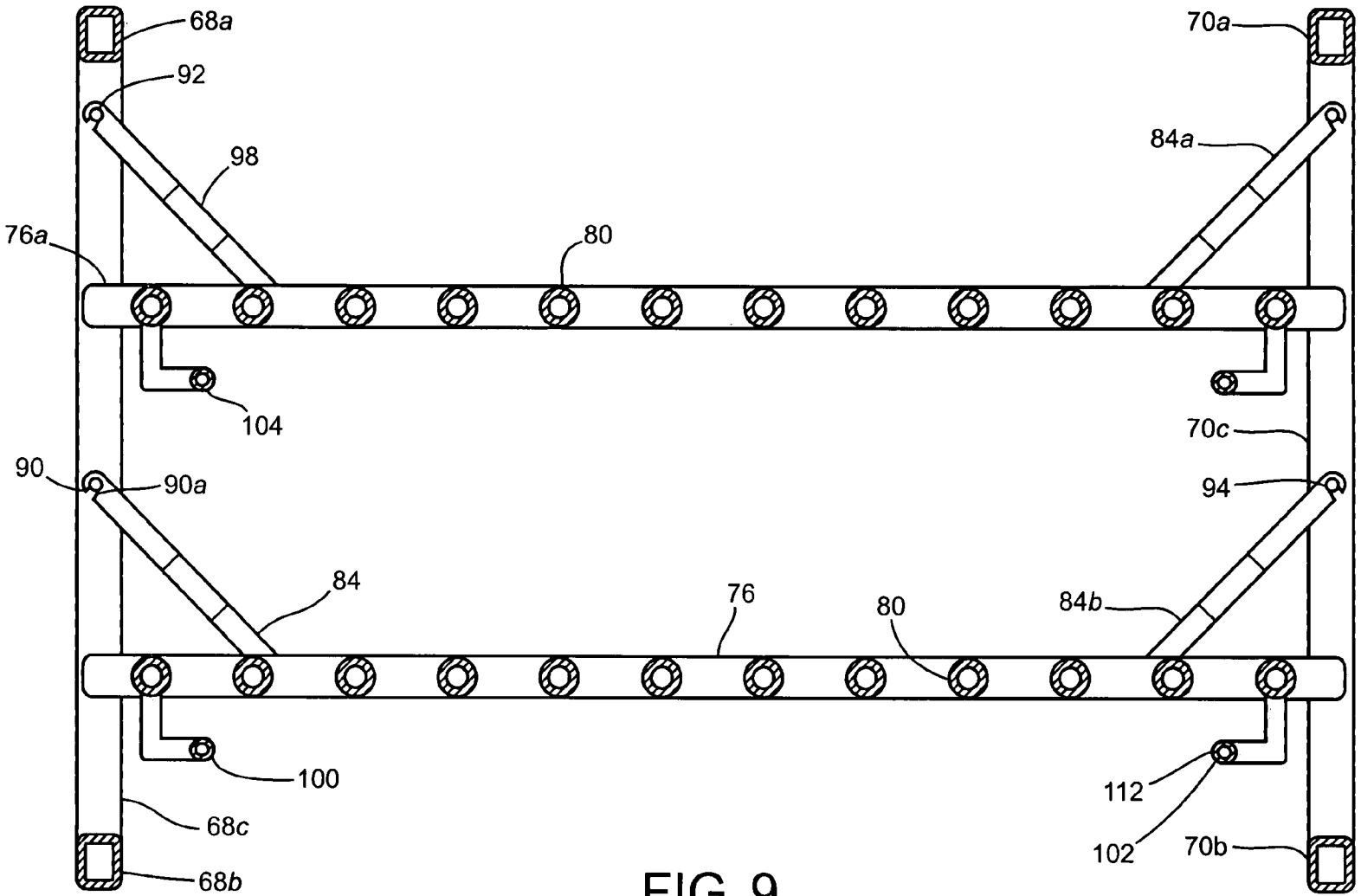
FIG. 9 is a front cross sectional view of the alternative embodiment of the present invention taken on line 9—9 of FIG. 8 illustrating a pair of tray support assemblies positioned in between left and right legs.

Referring now to FIG. 1, the trays 26 each interiorly fitted with a grate 48 may be placed within and supported by a folding frame structure 66, or as shown in FIG. 6, the trays may be alternatively arranged within the folding frame structure without the presence of the grates. In either one of these two embodiments of the present invention, the folding frame structure preferably comprises left and right legs 68, 70 pivotally fastened to at least one tray support assembly 72 situated thereinbetween. Each leg, as shown in FIG. 7, comprises upper and lower elongate horizontal members 68*a*, 70*a*, 68*b*, 70*b* and a pair of elongate vertical members 68*c*, 70*c* each having ends fastened to one another to form a leg of rectangular configuration. Although the legs primarily function to support the tray support assembly, the upper horizontal members may supplement as means for handling the folding frame structure, particularly useful in carrying the folding frame structure 66 from location to location and facilitating assembly and disassembly. Preferably, each leg 68, 70 is integrally constructed from a continuous piece of tubing and bent accordingly to form the desired rectangular shape of the leg. Each vertical member comprises an inner face 68*d*, 70*d* for engaging and mounting thereon a portion of the tray support assembly. As shown in FIG. 8, each tray support assembly 72 comprises forward and aft horizontal supports 74, 76 positioned parallel to one another with each horizontal support having a pair of ends 74*a*, 76*a* affixed to the left and right legs. Each end of the horizontal support comprises a stem 74*b*, 76*b* extending outwardly and perpendicular therefrom to engage and fit into an aperture 78 extending into and through the inner face 68*d*, 70*d* of each vertical member, which collectively serve as means for allowing the tray support assembly to simultaneously fold together with each of the legs for short- or long-term storage of the folding frame structure 66. Preferably, each stem comprises a predetermined length which allows for secure placement within the aperture while avoiding interference or binding with an outer face 68*e*, 70*e* of each vertical member. Like the structure noted for the grate 48, the tray support assembly 72 further comprises a plurality support bars 80 of elongate form positioned parallel to one another and situated perpendicular and connected at their ends to the horizontal supports 74, 76 to collectively form a plurality of lengthened openings 82, which suitably allow for placement and support of foot apparel while allowing uninhibited passage of water, snow and debris therethrough into the tray 26, as best illustrated in FIGS. 8 and 9. It is noted herein that the size of the lengthened openings may be altered in such a manner to accommodate specific needs, number, or configuration of the foot apparel. In order to prevent frictional binding of the horizontal support with that of the vertical member during pivotal movement, the support bars 80 comprise a predetermined length to establish the tray support assembly's size to fit accordingly within the confines of each leg 68, 70, preferably establishing a ¼" space in between the inner face and horizontal support. To enhance rigidity of the folding frame structure and maintain a perpendicular orientation of the tray support assembly 72 relative to the legs, each horizontal support comprises a pair of angular braces 84 each having top and bottom ends 84*a*, 84*b*. As illustrated in FIG. 6, the bottom end of each angular brace comprises an aperture 86 for receiving therethrough a fastener 88, rivet, or equivalent type of fastener which extends into and terminates within each horizontal support 74, 76. The top end of the angular brace is mounted to the vertical member 68*c*, 70*c* in such a manner as to allow the angular brace to extend approximately 45° to the longitudinal axis of the tray support assembly 72. Mounting of the angular brace 84 at this preferred angular relation is accomplished by a hook 90 integrally made part of the top end 84*a*. A pin 92 extending outwardly and perpendicular from the inner face 68*d*, 70*d* primarily functions to engage an inner space 90*a* of the hook and position the angular brace accordingly. In preferred applications, the inner space of the hook comprises a diameter which suitably promotes a frictionally fit about the pin. As shown in FIG. 7, each pin 92 comprises an end cap 94 to prevent the top end 84*a* of the angular brace from becoming inadvertently disengaged by the occurrence of lateral movement of the tray support assembly 72. A space 96 formed in between the inner face of the vertical member and end cap substantially corresponds to the thickness of the material to construct the angular brace 84, collectively configured to mitigate inadvertent release of the angular brace from the pin 92 and maintain rigidity to the folding frame structure 66 while in an assembled state. In preventing each of the angular braces from interfering or binding with the inner face 68*d*, 70*d* upon collapsing the folding frame structure, each angular brace 84 further comprises an offsetting intermediate member 98 integrally connected to and situated within the top and bottom ends 84*a*, 84*b*. The degree to which the angular brace is offset depends on the geometric configuration of the tray support assembly 72 and its ability to move and be located within the confines of the leg.

Connected to and hanging downwardly from the tray support assembly 72 are left and right tray rails 100, 102 for slidably receiving the tray 26. Each tray rail, as illustrated in FIGS. 6 and 7, comprises a pair of L-shaped members 104 each having vertical and horizontal elements 104*a*, 104*b*. The vertical element comprises a first end 106 integrally connected to the horizontal support 74, 76 and a second end 108 integrally connected to an end 110 of the horizontal element extending outwardly and perpendicular from the vertical element 104*a*. A rod 112 extending from and integrally connected to a free end 114 of each of the horizontal elements 104*b* serves in supplementing the strength of the tray rail 100, 102 to the extent of supporting the collective weight of the tray 26, foot apparel, and accumulating water, snow, and debris. Preferably, each horizontal element comprises a length substantially corresponding to the depth of the ledge to receive and adequately support the tray. To promote sliding of the tray in and out of the tray rails, each tray 26 comprises an effective length slightly less than the distance maintained in between the pair of tray rails 100, 102 mounted below the horizontal support members 74, 76.

In preparing the folding frame structure for receiving the trays 26, the folding frame structure 66 is opened if presently in a collapsed state by handling the upper elongate horizontal member 68*a* of the left leg and lower elongate horizontal member of the right leg or vice versa and pulling outwardly from one another until the tray support assembly 72 is positioned perpendicular to the elongate vertical members of the leg 68, 70. Once in this position, each angular brace 84 is pivotally moved about the fastener 88 attached to the horizontal support and positioned accordingly to permit the top end bearing the hook to engage the pin. Each tray 26 fitted with or without the grate 48 is then slidably positioned onto the tray rails 100, 102 of the tray support assembly, ensuring that the lower exposed surface 50 of the ledge fully rests upon and contacts the horizontal elements 104*b* of the L-shaped members and rods 112.

It can be seen from the foregoing that there is provided in accordance with this invention a simple and easily operated device, which is particularly suitable for supporting foot apparel and collecting and retaining water, snow, and debris temporally released therefrom. The rack and tray assembly is completely functional in terms of ridding water and debris from an entryway of a residential or commercial building structure while providing means for localizing the storage of foot apparel and the like. It is obvious that the components comprising the rack and tray assembly may be fabricated from a variety of materials, providing such selection or use of materials possess the capacity to withstand forces acting thereon throughout its duration of use in a residential or commercial setting. Accordingly, it is most desirable, and therefore preferred, to construct the tray from plastic and grate and folding frame structure from steel suitably coated with vinyl or an equivalent surface material capable of preventing premature corrosion of the substrate. To lessen the cost and simplify construction of the rack and tray assembly 10, the tray support assembly 72, legs 68, 70 and grate 48 are preferably fabricated from unified pieces of tubular metal, with the tray being injected molded in the form noted herein to meet its desired utility.

While there has been shown and described a particular embodiment of the invention, it will be obvious to those skilled in the art that various changes and alterations can be made therein without departing from the invention and, therefore, it is aimed in the appended claims to cover all such changes and alterations which fall within the true spirit and scope of the invention.

What is claimed is:

1. A rack and tray assembly for supporting foot apparel and containing debris and liquids released therefrom, said assembly comprising, in combination:

a tray having a base integrally connected to inclined sides extending upwardly therefrom, along the periphery thereof and terminating at an upper rim, said rim comprising a ledge having upper and lower exposed surfaces;

a grate having a pair of shortened end members and a pair of side members collectively joined end to end to form a frame and define an interior space receiving therein a plurality of support members integrally connected to said side members and positioned parallel to said shortened end members, said frame having an overall geometric configuration substantially conforming to said ledge to permit said frame to rest atop said upper exposed surface, each of said support members being equally spaced apart to form a plurality of elongate openings for passage into said tray debris and liquids released from foot apparel resting atop said support member; and a folding frame structure having left and right legs pivotally fastened to at least one tray support assembly situated thereinbetween, each of said legs comprising upper and lower elongate horizontal members and a pair of elongate vertical members each having ends fastened to one another to form a leg of rectangular configuration, said tray support assembly comprising forward and aft horizontal supports each having a pair of ends affixed to said left and right legs and positioned parallel to one another, each of said ends of said horizontal supports comprising a stem extending outwardly and perpendicular therefrom to engage and fit into an aperture extending into and through an inner face of each of said vertical members and left and right tray rails integrally connected to said horizontal supports and hanging downwardly therefrom to engage said lower exposed surface to the extent of supporting said tray below said tray support assembly.

2. An assembly as set forth in claim 1, wherein said inclined sides extend angularly outward from said base by approximately 25° from an axis perpendicular to said base.

3. An assembly as set forth in claim 1, wherein said rim comprises a supportive wall integrally connected thereto and extending upwardly from said upper exposed surface of said ledge to supplement rigidity of said tray and retain positioning of said frame about said tray while foot apparel is being slidably positioned about said support members.

4. An assembly as set forth in claim 3, wherein said supportive wall comprises a height substantially equivalent to the height of said frame to mitigate undue interference between said supportive wall and foot apparel as the foot apparel traverses said support members and onto and over said supportive wall and said frame.

5. An assembly as set forth in claim 1, further comprising a cabinet having left and right sidewalls and top and bottom sides collectively connected together to form a box-like structure defining an interior compartment for housing therein at least one tray adaptably fitted with said frame having said support member, said left and right sidewalls each having an inner planer surface for mounting thereon left and right guide rails, respectively, each extending outwardly therefrom to engage said lower exposed surface and support said tray.

6. An assembly as set forth in claim 5, wherein said cabinet is fitted with a cushioned seat mounted atop said top side and is structurally reinforced by a back panel fixedly attached along a back leading edge of the collective arrangement of said left and right sidewalls and said top and bottom sides, said cabinet further comprising a pair of rotatable lock mechanisms fastened along a front leading edge of said cabinet to retain positioning of said tray within said cabinet during movement of the foot apparel.

7. A foldable rack and tray assembly for supporting foot apparel and containing debris and liquids released therefrom, said assembly comprising, in combination:

a tray having a base integrally connected to inclined sides extending upwardly therefrom, along the periphery thereof and terminating at an upper rim, said rim comprising a ledge having upper and lower exposed surfaces; and a folding frame structure having left and right legs pivotally fastened to at least one tray support assembly situated thereinbetween, each of said legs comprising upper and lower elongate horizontal members and a pair of elongate vertical members each having ends fastened to one another to form a leg of rectangular configuration, said tray support assembly comprising left and right tray rails integrally connected thereto and hanging downwardly therefrom to engage said lower exposed surface to the extent of supporting said tray below said tray support assembly and forward and aft horizontal supports each having a pair of ends affixed to said left and right legs and positioned parallel to one another, each of said ends of said horizontal supports comprising a stem extending outwardly and perpendicular therefrom to engage and fit into an aperture extending into and through an inner face of each of said vertical members, said horizontal supports each being locked into position about said legs by a pair of angular braces each having top and bottom ends and an offsetting intermediate member situated thereinbetween substantially serving to prevent binding of said brace with that of said inner face upon collapsing said folding frame structure, said bottom end of each brace comprising an aperture for receiving therethrough a fastener extending into and terminating within each of said horizontal supports, said top end having a hook integrally made part thereof engaging a pin extending outwardly from said inner face of said vertical member.

8. An assembly as set forth in claim 7, wherein said left and right tray rails each comprise a pair of L-shaped members each having vertical and horizontal elements, said vertical element having a first end integrally connected to said horizontal support and a second end integrally connected to an end of said horizontal element extending outwardly and perpendicular from said vertical element to engage said lower exposed surface of said ledge.

9. An assembly as set forth in claim 8, wherein said L-shaped members of each of said tray rails are integrally connected by a rod extending between free ends of said horizontal elements.

10. An assembly as set forth in claim 7, wherein said pin comprises an end cap affixed thereto to prevent said top end of said brace from becoming inadvertently disengaged by the occurrence of lateral movement of said tray support assembly.

11. An assembly as set forth in claim 7, wherein said tray support assembly further comprises a plurality of support bars of elongate form situated perpendicular and connected to said horizontal supports and equally spaced apart from one another forming lengthened openings thereinbetween collectively serving to allow simultaneous support of foot apparel and uninhibited passage of debris and liquids therethrough into said tray.

12. An assembly as set forth in claim 7, wherein each of said legs is formed from a continuous piece of tubing and bent accordingly to define said upper and lower elongate horizontal members and said elongate vertical members.

13. An assembly as set forth in claim 7, wherein said tray is fabricated from plastic and each of said legs is fabricated from metal suitably coated with a corrosion resisting material.

14. An assembly as set forth in claim 7, further comprising a grate having a pair of shortened end members and a pair of side members collectively joined end to end to form a frame and define an interior space receiving therein a plurality of support members integrally connected to said side members and positioned parallel to said shortened end members, said frame having an overall geometric configuration substantially conforming to said ledge to permit said frame to rest atop said upper exposed surface, each of said support members being equally spaced apart to form a plurality of elongate openings for passage into said tray debris and liquids released from foot apparel resting atop said support members.

* * * * *